US009212444B2

(12) United States Patent
Griswold et al.

(10) Patent No.: US 9,212,444 B2
(45) Date of Patent: Dec. 15, 2015

(54) AUTOMATIC TEMPERATURE CONTROL FOR A LAUNDRY TREATING APPLIANCE

(75) Inventors: Eric G. Griswold, Saint Joseph, MI (US); Jon D. Strait, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1021 days.

(21) Appl. No.: 13/150,283

(22) Filed: Jun. 1, 2011

(65) Prior Publication Data

US 2012/0304395 A1 Dec. 6, 2012

(51) Int. Cl.
*D06F 33/02* (2006.01)
*D06F 39/08* (2006.01)

(52) U.S. Cl.
CPC ..... *D06F 33/02* (2013.01); *D06F 39/087* (2013.01); *D06F 2202/04* (2013.01); *D06F 2202/08* (2013.01); *D06F 2204/088* (2013.01)

(58) Field of Classification Search
CPC ... D06F 39/088; D06F 33/02; D06F 2202/08; D06F 2202/088
USPC ..... 8/158
See application file for complete search history.

(56) References Cited

U.S. PATENT DOCUMENTS

| | | | | |
|---|---|---|---|---|
| 4,031,911 | A | 6/1977 | Frazar | |
| 4,406,401 | A | 9/1983 | Nettro | |
| 4,643,350 | A * | 2/1987 | DeSchaaf et al. | 236/12.12 |
| 4,779,430 | A | 10/1988 | Thuruta et al. | |
| 5,231,722 | A | 8/1993 | Shacklock et al. | |
| 5,271,251 | A * | 12/1993 | Kovich et al. | 68/171 |
| 5,439,019 | A | 8/1995 | Quandt et al. | |
| 6,255,952 | B1 | 7/2001 | Jang | |
| 6,327,730 | B1 | 12/2001 | Corbett | |
| 6,499,321 | B1 | 12/2002 | Rhodes et al. | |
| 2008/0172804 | A1 * | 7/2008 | Vanhazebrouck et al. | 8/158 |

FOREIGN PATENT DOCUMENTS

| | | | |
|---|---|---|---|
| DE | 3703918 | A1 | 8/1988 |
| DE | 3828813 | A1 | 3/1990 |
| DE | 10222406 | A1 | 12/2003 |
| JP | 4105696 | A | 4/1992 |
| JP | 6254285 | A | 9/1994 |
| JP | 10057684 | A | 3/1998 |
| JP | 2004222760 | A | 8/2004 |
| JP | 2005261692 | A | 9/2005 |
| KR | 19940001456 | B1 | 1/1997 |
| KR | 19930017161 | B1 | 3/1997 |
| KR | 101054430 | B1 * | 7/2006 |
| WO | 2010/054996 | A1 | 5/2010 |

OTHER PUBLICATIONS

Machine Translation of KR101054430 (Jul. 2006).*
German Search Report for corresponding DE102012102879, Dec. 10, 2012.

* cited by examiner

*Primary Examiner* — Jason Ko
*Assistant Examiner* — Spencer Bell

(57) ABSTRACT

A method for controlling the operation of a laundry treating appliance that includes alternately supplying hot and cold water to maintain the temperature of the mixed water to a preset temperature.

14 Claims, 5 Drawing Sheets

AUTOMATIC TEMPERATURE CONTROL FOR A LAUNDRY TREATING APPLIANCE

BACKGROUND OF THE INVENTION

Laundry treating appliances, such as clothes washing machines, may be provided with a treating chamber for receiving a laundry load for treatment according to a cycle of operation using at least one of the hot water and cold water. For some cycles of operation, the hot and cold water may be mixed to provide water at a predetermined temperature suitable for that cycle of operation.

SUMMARY OF THE INVENTION

A method of operating a laundry treating appliance comprising a treating chamber for receiving laundry to be treated according to an automatic cycle of operation, hot and cold water supplies, and a supply conduit fluidly coupling the hot and cold water supplies to the treating chamber, the method comprising alternately supplying of water from the hot and cold water supplies through the supply conduit to the treating chamber to form a mixture of hot and cold water in the treating chamber having a predetermined set temperature; sensing a temperature of the supply conduit during the alternate supplying; switching from the cold water supply to the hot water supply when the sensed temperature satisfies a low temperature limit (LTL); switching from the hot water supply to the cold water supply when the sensed temperature satisfies a high temperature limit (HTL); sensing the ambient air temperature; and setting the LTL and the HTL based on the sensed ambient air temperature.

DESCRIPTION OF EMBODIMENTS OF THE INVENTION

Figure 1:
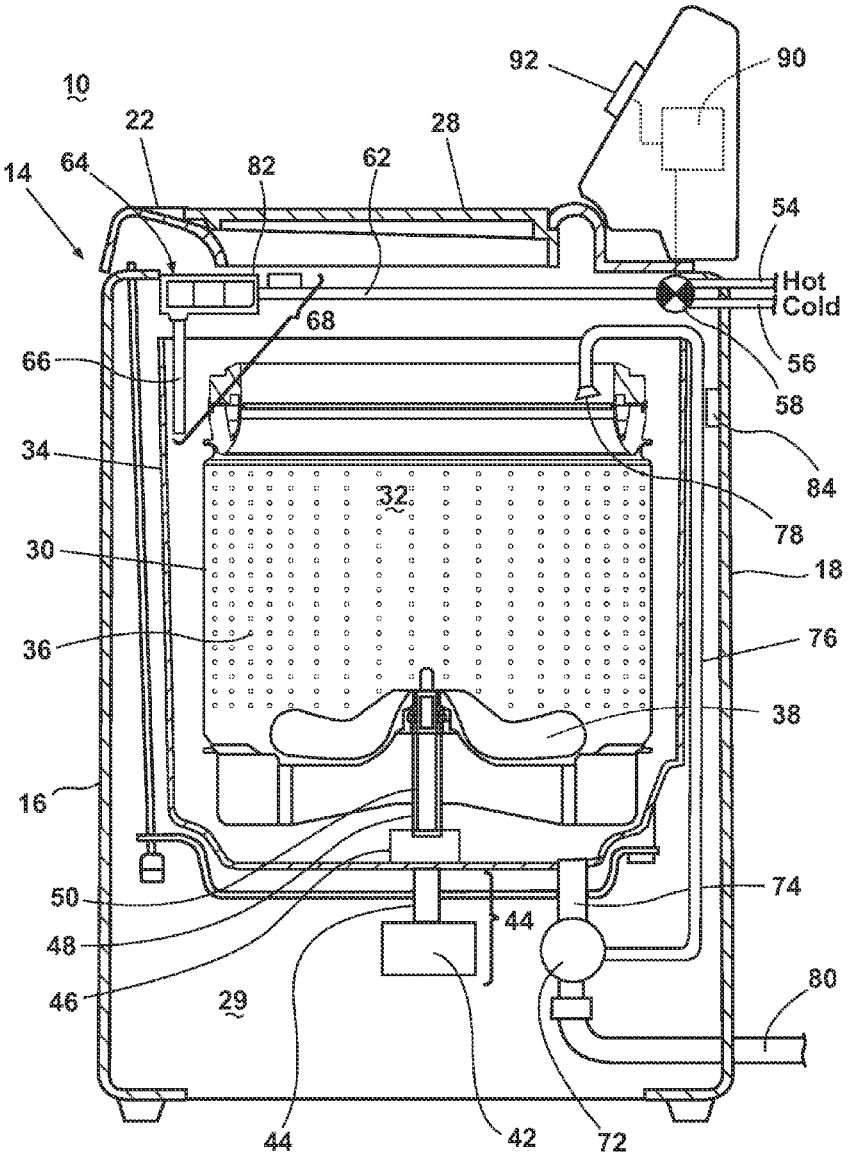
FIG. 1 is a schematic, cross-sectional view of a laundry treating appliance in the form of a vertical axis washing machine according to one embodiment of the invention.

FIG. 1 is a schematic, cross-sectional view of a laundry treating appliance 10 in the form of a washing machine according to one embodiment of the invention. The methods described herein may be used with any suitable laundry treating appliance and are not limited to use with washing machines, including the laundry treating appliance 10 described below and shown in the drawings. As illustrated, the laundry treating appliance 10 is a vertical-axis washing machine; however, the laundry treating appliance 10 may be any appliance which performs a cycle of operation on laundry, non-limiting examples of which include a horizontal-axis washing machine; a combination washing machine and clothes dryer; a tumbling or stationary refreshing/revitalizing machine; an extractor; a non-aqueous washing apparatus; and a revitalizing machine.

The laundry treating appliance 10 described herein shares many features of a traditional automatic washing machine, which will not be described in detail except as necessary for a complete understanding of the invention. For illustrative purposes, the method will be described with respect to a washing machine with one or more articles making up the laundry load, with it being understood that the invention may be adapted for use with other types of laundry treating appliances.

The laundry treating appliance 10 may include a cabinet 14, which may be a frame or chassis to which decorative panels may be mounted. The cabinet 14 may be defined by a front wall 16, a rear wall 18, and a pair of side walls 20 (only one shown) supporting a top wall 22. The top wall 22 may have an openable door or lid 28 and may be selectively moveable between opened and closed positions to close an opening in the top wall 22, which provides an access to an interior 29 of the cabinet 14.

A rotatable drum 30 may be disposed within the interior 29 of the cabinet 14 and defines a treating chamber 32 for treating laundry according to a wash cycle. The drum 30 may be positioned within an imperforate tub 34. The drum 30 may include a plurality of perforations 36, such that liquid may flow between the tub 34 and the drum 30 through the perforations 36. The drum 36 may rotate or oscillate about a vertical axis of rotation at least in either a clockwise or counterclockwise direction at various speeds during a cycle of operation.

While the illustrated washing machine 10 includes both the tub 34 and drum 30, with the drum 30 defining the laundry treating chamber 32, it is within the scope of the invention for the washing machine 10 to include only one receptacle, with the receptacle defining the laundry treating chamber for receiving the laundry load to be treated.

A clothes mover 38 may be located in the drum 30 and rotated or oscillated about a vertical axis of rotation. A drive system 40 is provided for rotating the drum 30 and clothes mover 38. The drive system comprises a motor 42 with an output shaft 44, which is selectively coupled by a coupling mechanism 46 to a spin tube 48 and agitator shaft 50 as needed. The spin tube 48 has one end affixed to the drum 30 such that rotation of the spin tube 48 by the motor 42 will rotate the drum 30. Similarly, the agitator shaft 50 has one end coupled to the clothes mover 38 such that rotation of the agitator shaft 50 by the motor 42 will rotate the clothes mover 30. The coupling mechanism 46 may take on many different forms, such as a clutch, gearbox, or wrapped spring, to name a few. The purpose of the coupling mechanism 46 is to couple the motor, as desired, to the spin tube 48 and/or agitator shaft 50 to effect the separate or co-rotation of the drum 30 and clothes mover 38.

A liquid supply system may be provided to supply liquid, with or without treating chemistry, for use in the treating chamber 32. As illustrated, the liquid supply system comprises hot water supply 54 and cold water supply 56 extending from corresponding household supplies to a valve assembly 58. An output conduit 62 from the valve assembly 58 is fluidly coupled to a treating chemistry dispenser 64, which is fluidly coupled to a tub conduit 66, such that water supplied from the hot and cold water supplies 54, 56 may be provided to the dispenser 64, where treating chemistry is added, if desired, and the mixture of water and treating chemistry may then be provided to the tub 34. The output conduit 62, dispenser 64, and tub conduit 66 collectively form a supply conduit 68 from the valve assembly 58 to the tub 34.

It should be noted that other fluid conduits could be provided to form multiple liquid paths for the supply conduit 68. For example, the dispenser 64 may be more than one liquid path, with one or more of the liquid paths passing through one or more dispensing units, such as cups, where treating chemistry is stored, and one or more liquid paths that bypass the cups. Further, another conduit could be provided that completely bypasses the dispenser 64 and flows into the tub. It is also possible for the supply conduit to empty into the treating chamber 32, instead of into the tub 34.

The valve assembly 58 may be operated to selectively provide hot and hold water to the output conduit 62. The relative supply times of the hot and cold water may be used to control the temperature of the mixed water. The dispenser 64 may be a single-use dispenser, that stores and dispenses a single dose of treating chemistry and must be refilled for each cycle of operation, or a multiple-use dispenser, also referred to as a bulk dispenser, that stores and dispenses multiple doses of treating chemistries over multiple executions of a cycle of operation.

A liquid recirculation system is provided for recirculating liquid from the tub 34 into the treating chamber 32. As illustrated, the liquid recirculation system comprises a pump 72 having a suction conduit 74 coupled to the tub 34 and a recirculation conduit 76 terminating in a nozzle 78 located above the open top of the drum 30. A drain conduit 80 extends from the pump 72 and may be fluidly connected to a household drain. With this configuration, any liquid in the tub 34 may be recirculated into the open top of the drum 34 for dispensing onto the top of any laundry residing in the treating chamber 34. When the liquid is no longer needed, it may be drained to the household drain.

A temperature sensor 82 in the form of a thermistor may be operably coupled to the supply conduit 68 to sense the temperature of the supply conduit 68 and outputting a corresponding signal, which is indicative of the temperature of the water passing through the supply conduit 68. As illustrated, the temperature sensor 82 is located on the output conduit 62 from the valve assembly 58, but the temperature sensor 82 may be located anywhere in the supply conduit 68.

An additional temperature sensor 84 in the form of a thermistor may be provided with the laundry treating appliance 10 at any location suitable for sensing an ambient air temperature and outputting a corresponding signal. For example, the temperature sensor 84 may be coupled to the inner wall of the cabinet 14 such that the ambient air temperature in the interior 29 of the cabinet 14 may be separately sensed. While the temperature sensor 84 may separately sense the ambient air temperature in the interior 29 of the cabinet 14, it is understood that the temperature sensor 82, thermally coupled to the output conduit 62, may be used to sense the ambient air temperature in the interior 29 of the cabinet 14. However, when using the temperature sensor 82 for sensing both the water temperature and the ambient air temperature, steps must be taken to ensure the water temperature does not interfere with the ambient air temperature sensing. For example, it can be presumed that if a certain amount of time has lapsed since the actuation of the valve assembly 58 that the output conduit 62 is at the same temperature as the ambient air.

Figure 2:
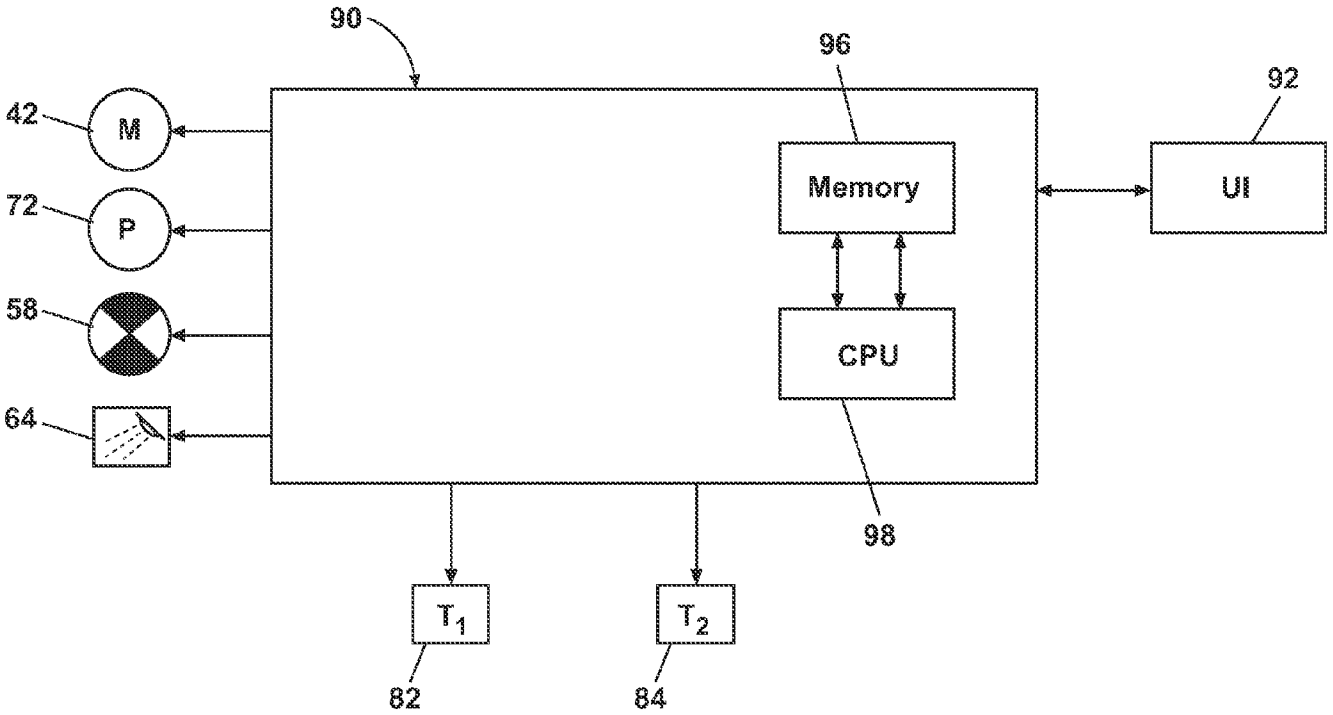
FIG. 2 is a schematic representation of a controller for controlling the operation of one or more components of the laundry treating appliance of FIG. 1.

Referring to FIG. 2, the laundry treating appliance 10 may further comprise a controller 90 coupled to various working components and sensors of the laundry treating appliance 10 to control the operation of the working components and sensors of the washing machine 10 to implement a cycle of operation. A user interface 92 may be operably coupled to the controller 90 to provide communication between the user and the controller 90. The user interface 92 may include one or more knobs, switches, displays, and the like for communicating with the user, such as to receive input and provide output.

A memory 96 and a central processing unit (CPU) 98 may be provided to the controller 90. The memory 96 may be used for storing an adjustment algorithm or other control software that may be executed by the CPU 98 in completing a cycle of operation of the laundry treating appliance 10 and any additional software. The memory 96 may also be used to store information, such as a database or table, and to store data received from the one or more components of the laundry treating appliance 10 that may be communicably coupled with the controller 90.

The controller 90 may be operably coupled with one or more components of the laundry treating appliance 10 for communicating with and/or controlling the operation of the components to complete a cycle of operation. For example, the controller 90 may be coupled with the valve supply 58 and chemistry dispenser 64 for controlling the temperature and flow rate of liquid into the treating chamber 32; the pump 72 for controlling the amount of liquid in the treating chamber 32; the motor 42 for controlling the direction and speed of rotation of the drum 30 or clothes mover 38; and the user interface 92 for receiving user selected inputs and communicating information to the user. The controller 90 may also receive input from one or more temperature sensors 82, 84, such as thermistors, which may detect the temperature of the liquid passing through the supply conduit 68 and being supplied to the treating chamber 32, or ambient air temperature in the interior 29 of the cabinet 14. The controller 90 may also receive input from various additional sensors or components, which are known in the art and not shown for simplicity. Non-limiting examples of additional sensors and components that may be communicably coupled with the controller 90 include: a weight sensor, a motor torque sensor, and a heating element or the like.

It is generally understood that the temperature of liquid may need to be selected for treating different laundry, depending on the laundry load, soil load, laundry color, laundry type, or degree of exposure to bacteria or germs. Therefore, the operation of the washing machine 10 may include supplying both hot and cold water into the treating chamber 32 until the temperature of mixed water may reach to a preset temperature according to a wash cycle. For example, the volume or ratio of the hot and cold water supplied into the treating chamber 32 may be determined based on the type and amount of the laundry load in a way that the temperature of mixed water in the interior of the treating chamber 32 may reach to a preset temperature specifically designed to the laundry load. It may be contemplated that the temperature of mixed water within a predetermined range may be one of the critical parameters in improving the quality of the laundry load.

The hot water and cold water may be supplied into the treating chamber 32 in two ways. First, the hot and cold water may be simultaneously supplied into the treating chamber 32. Under this condition, less time may be required in filling the treating chamber 32 to a predetermined level due to the increased influx of water from two water inlets 54, 56 into the treating chamber 32. Further, the temperature of the mixed water may be maintained relatively uniformly along the entire supply conduit 68 and in the tub. Undesirably, high water influx from both hot and cold water inlets 54, 56 into the treating chamber 32 may lead to an overflow of the water while passing the dispenser 74 and surrounding drawer of the dishwasher 10. The water may also escape exteriorly of the washing machine 10 and/or the outside the tub 34 surrounding the treating chamber 32.

Alternatively, the hot and cold water may be alternately supplied into the treating chamber 32, making it less likely that the overflow of water outside the dispenser 74 happens. Further the volume of water flowing into the treating chamber 32 may not splash or escape outside the tub 34 or the washing machine 10. Thus, to avoid overflow, the alternating supply is often selected over the simultaneous supply.

However, the alternate supply of hot and cold water makes it impossible to directly determine the temperature of the mixed water in the tub when the temperature sensor 82 remains in the supply conduit 68 because the temperature sensor 82 alternately supplies hot and cold water temperatures, instead of the mixed water temperature. The temperature sensor 82 could be moved to the tub 34 to directly read the mixed water temperature, but this is not preferred due to the delay caused by water absorption by the clothes.

To produce a mixed water in the tub at a predetermined temperature using the alternate supply of hot and cold water, the hot and cold water may be alternately supplied for time periods based on a low temperature limit (LTL) and a high temperature limit (HTL) set as a low and high temperature threshold. The specific LTL and HTL values are experimentally determined for a given liquid volume and predetermined mixed water temperature.

Figure 3:
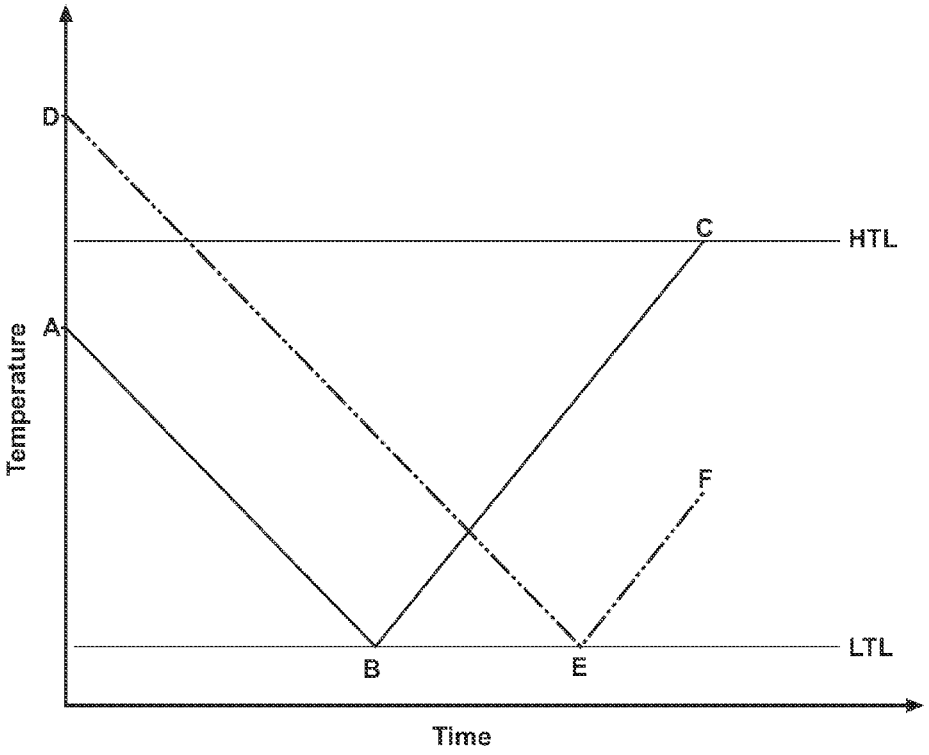
FIG. 3 is a plot of alternate actuations of hot and cold water supplies in the treating chamber at different ambient air temperatures, with fixed low temperature limit (LTL) and high temperature limit (HTL) set for different ambient air temperatures.

FIG. 3 illustrates the methodology of alternately actuating hot and cold water supplied in the treating chamber 32. Initially, the cold water is supplied until the temperature sensed by temperature sensor 82 satisfies the LTL, followed by the supply of hot water for a time period until the water temperature satisfies the HTL and the like until the water fill may reach to a predetermined level, which is indicative of a predetermined volume of water for the selected cycle of operation along the route of A-B-C.

Referring to the route of A-B-C, at the beginning of the water fill, the temperature sensor 84 may sense a temperature reading A which is illustrated as being below the HTL and above the LTL. Under this condition, the controller actuates the cold water supply 56 to supply cold water until the temperature reading from temperature sensor 82 reaches the LTL at B. As the predetermined water level is not yet reached, the controller 90 shuts off the cold water supply 56 and turns on the hot water supply 54. The hot water supply 54 remains on until the temperature reading from the temperature sensor 82 may satisfy the temperature C at HTL. For purposes of this illustration, it is presumed the predetermined water level is reached at C. However, if the predetermined water volume was not reached, the hot and cold water supplies 54, 56 would be alternately actuated until the predetermined water level is satisfied in the treating chamber 32.

It should be noted that the temperature sensor 82, especially when the temperature sensor 82 is a thermistor, is not in direct contact with the water flowing through the supply conduit 68. So, the temperature sensor 82 is reading the temperature of the material forming the supply conduit 68. Assuming sufficient time has lapsed since the last cycle of operation, the material forming the supply conduit 68 will be at ambient air temperature and the initial reading of the temperature sensor 82 is that of the ambient air temperature. However, this may not always be the case, which is why the second temperature sensor 84 is useful to determine the ambient air temperature.

It is also notable that because the temperature sensor 82 senses the temperature of the material forming the supply conduit 68, there will inherently be some delay between the cooling/heating effect of the cold/hot water on the supply conduit 68 and when that effect is sensed by the temperature sensor 82. If this delay becomes important, it can be accounted for in setting the HTL and LTL.

While the alternate actuations with the HTL and LTL may work under some circumstances, it may be noticed that under other circumstances, an incorrect water mixture temperature was achieved. It was discovered that the variation of the ambient air temperature was responsible for the incorrect water mixture temperature. The HTL and LTL values for each cycle of operation and the corresponding predetermined water level were initially experimentally determined in laboratory conditions where there was no variation in the ambient air temperature, whereas in real world use, there is a great variation in the ambient air temperature.

The effect of the variation in the ambient air temperature is illustrated as route D-E-F in FIG. 3, where it is illustrated that the initial temperature D is higher than temperature A, with D being higher than the ambient air temperature where the HTL and LTL values were experimentally determined. As the ambient air temperature D is above the LTL, the cold water supply 56 is turned on until the temperature reading satisfies the LTL at E. Under this condition, it can be seen that the cold water supply 56 is on for period of time greater than the time period A-B.

When the temperature reading satisfies LTL at E, the cold water supply 56 may be turned off. Subsequently, the hot water supply 54 may be on until the temperature satisfies the HTL or until the predetermined water level is reached. In this illustration, the predetermined water level is reached at temperature F before the HTL is satisfied. The time period during which the hot water supply 54 was on for E-F is much less than for B-C. Thus, mixture of hot and cold water is quite different for A-B-C and D-E-F, which leads to a much different temperature for the resulting mixed water of the same volume.

Figure 4:
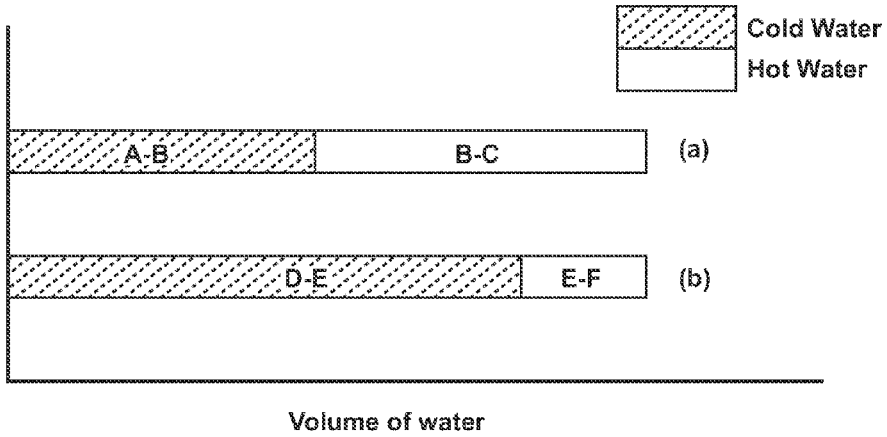
FIG. 4 is a bar graph illustrating the comparative volumes of cold and hot water added during the alternative actuations for the laundry treating appliance of FIG. 3.

This difference is best seen in FIG. 4, where the comparative volumes of cold and hot water added to the treating chamber 32 during the alternate actuations of FIG. 3 are schematically illustrated. The length of each bar schematically corresponds to the water volume provided during the alternate actuations in FIG. 3. For example, the bar length A-B may correspond to the cold water volume actuated during A-B in FIG. 3.

As illustrated, the volume of the cold (A-B) and hot (B-C) water are approximately the same for this illustration, whereas the cold water volume (D-E) far exceeds the volume of hot water actuated (E-F). As a result, and the temperature of the mixed water will substantially differ for these two methods because of the variation in the ambient temperature. For example, under this condition, the temperature of the mixed water for the route D-E-F will be far cooler than the expected preset temperature associated with the HTL and LTL.

The reduced water temperature of the mixed water for the route D-E-F is attributable to the extra time it takes for the initial supply of cold water to reach the LTL. The hot water supply 54 does not have time to "catch up" before the water level is reached. One could compensate by discarding the water level limit and letting the hot water run until the desired mixed temperature is achieved, but this would undesirably lead to a greater than needed water volume, which would be wasteful of the resource and, depending on the cycle of operation, may negatively impact the cleaning performance.

The invention addresses problem associated with setting different LTL and HTL with respect to the varying ambient air temperature such that the volume ratio of the hot and cold water may be maintained in a desired ratio to reach to a preset temperature by monitoring the ambient air temperature and calculating corresponding LTL and HTL based on the ambient air temperature.

Figure 5:
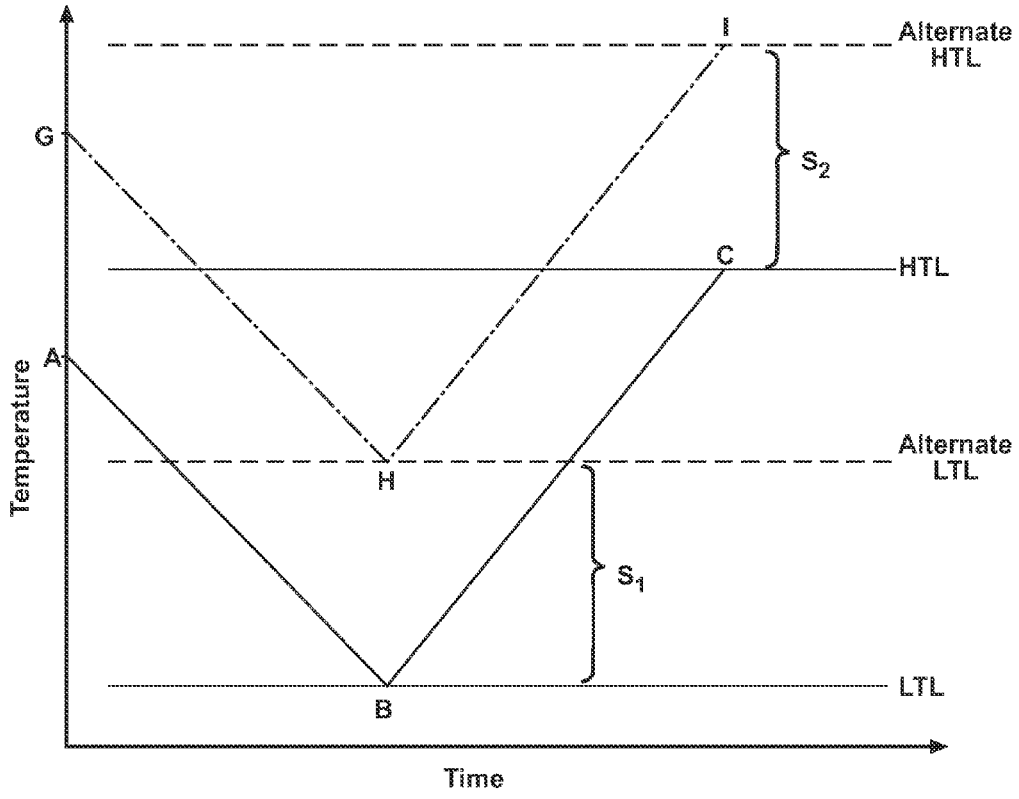
FIG. 5 is a plot of alternate actuations of the hot and cold water supplies in the treating chamber, illustrating a shift of a LTL and HTL for higher ambient air temperature according to another embodiment of the invention.

FIG. 5 illustrates how setting the LTL and HTL based on the ambient air temperature results in the same predetermined volume of mixed water at the predetermined temperature. The route A-B-C is reproduced in FIG. 5 for comparison with route G-H-I according to an another embodiment of the invention, which includes alternate actuations of hot and cold water in the treating chamber 32, with a shift of the LTL and HTL to an alternate LTL and alternate HTL as a function of the higher ambient air temperature. As illustrated, in case the ambient air temperature reading G varies sufficiently from the ambient air temperature present during the experimental determination of the HTL and LTL values, at least one of the HTL and LTL may be accordingly adjusted to at least one of the alternate HTL and alternate LTL. The adjustment may be performed by the adjustment algorithm or other control software which outputs the alternate HTL and alternate LTL, based on the shift in the ambient air temperature sensed from the temperature sensor 84. The magnitude of adjustment from the HTL and/or LTL to the alternate HTL and/or alternate LTL may be represented as S1 and S2, respectively. While the magnitude of the S1 and S2 may be same, it may be understood that the magnitude of the S1 and S2 may be different in another embodiment.

As illustrated, by adjusting the HTL and LTL to the alternate HTL and alternate LTL with the change in the ambient air temperature, the volume of hot and cold water during the alternate actuations G-H-I may be configured to maintain the proper ratio, similar to the route A-B-C, such that the temperature of water mixture may be maintained at a preset temperature.

While the adjustment of one of the LTL and HTL may be possible for cycles of operation in which the temperature of mixed water may be between that of hot and cold water, it is understood that at least one of the LTL and HTL may not be adjusted for a cycle of operation using solely one of the hot water and cold water.

Figure 6:
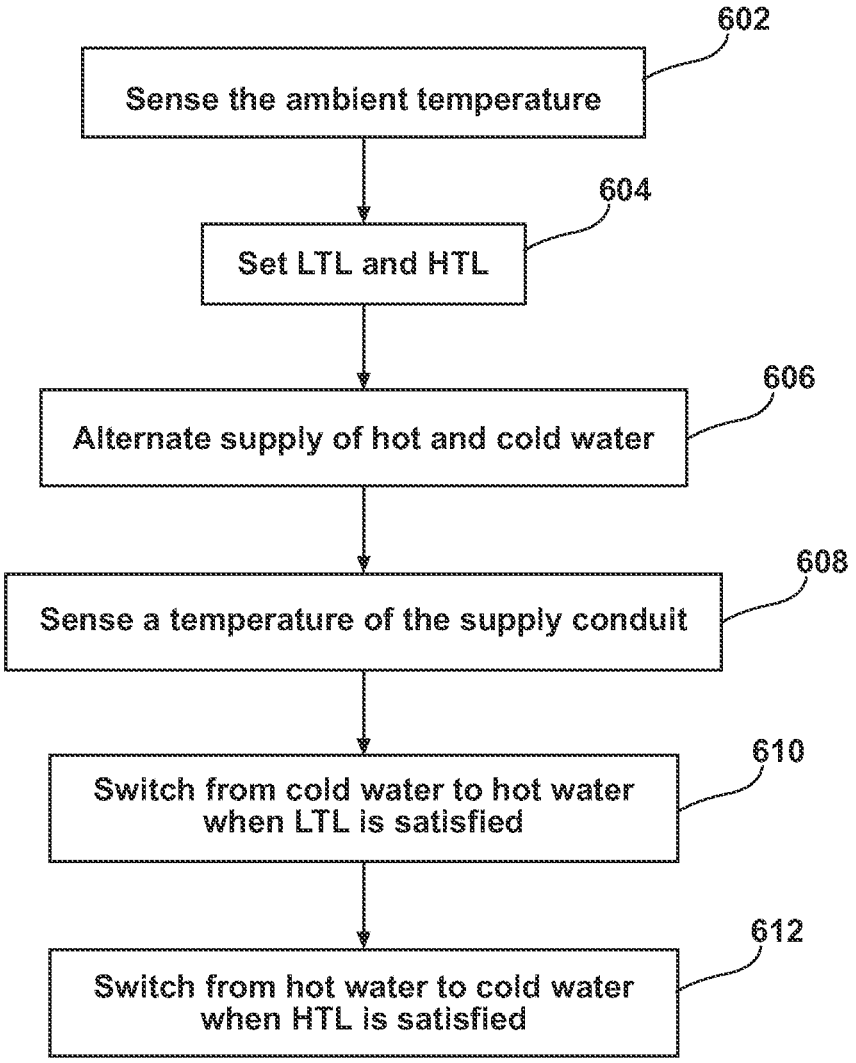
FIG. 6 is a flow chart for controlling the temperature of water mixture according to yet another embodiment of the invention.

Referring now to FIG. 6, a flow chart of a method 600 for controlling the temperature of water mixture according to yet another embodiment of the invention is illustrated. The sequence of steps depicted for this method and the proceeding methods is for illustrative purposes only, and is not meant to limit any of the methods in any way as it is understood that the steps may proceed in a different logical order or additional or intervening steps may be included without detracting from the invention.

The method 600 starts with assuming that the user has placed one or more laundry articles for treatment within the treating chamber 32 and selected a cycle of operation through the user interface 92 while the one or more laundry articles may not be placed within the treating chamber 32 in another embodiment. The method 600 may be implemented during any portion of a cycle of operation or may be implemented as a separate cycle of operation.

At 602, the ambient air temperature may be sensed using the temperature sensor 84 while it is understood that the temperature sensor 82 may be also used to sense the ambient air temperature. The ambient air temperature reading may be transmitted to the controller 90 to calculate HTL and LTL. At 604, at least one of the HTL and LTL may be determined experimentally for a given liquid volume and predetermined mixed water temperature, based on the ambient air temperature sensed by one of the temperature sensors 82, 84. Alternatively, at least one of the HTL and LTL may be calculated and set by the adjustment algorithm or other control software in the controller 90. For example, in case the ambient air temperature varies from the laboratory condition such as 70 degree Fahrenheit, at least one of the HTL and LTL may be adjusted by the adjustment algorithm or other control software. Generally, the ambient air temperature need only be sensed or updated by the temperature sensor 82, 84 generally once at the beginning of each cycle. At 606, one of the hot and cold water supplies 54, 56 may be alternately turned on to supply one of the hot and cold water in the treating chamber 32. For example, the cold water supply 56 may be turned on in the first place, followed by the actuation of the hot water supply 54 until the mixed water fill reaches to a predetermined level.

At 608, the temperature of one of the cold and hot water passing through the supply conduit 68 may be sensed by the temperature sensor 82, and the temperature reading may be sent to the controller 90 to guide whether the temperature reaches to one of the HTL and LTL. At 610 and 612, the supply of the hot and cold water may be alternated depending on the temperature of the supply conduit 68 measured by the temperature sensor 82 at 608. For example, when the cold water supply 56 is turned on and the temperature of the supply conduit 68 satisfies the LTL, the cold water supply 56 may be turned off. Subsequently, the hot water supply 54 may be on. When the temperature of the supply conduit 68 satisfies the HTL, the hot water supply 54 may be turned off and the like, until a predetermined fill level may be satisfied in the treating chamber 32.

The setting the LTL and HTL values for a sensed ambient air temperature need not be done for all cycles. Some cycles are solely cold water or hot water cycles in which only cold or hot water is supplied.

In most cases, it is preferred that the first water supply be a cold water supply regardless of whether the ambient temperature is below the LTL. By supplying cold water first, even for a short duration, it reduces the likelihood of harming the laundry by the direct supply of hot water onto the laundry. In those cases where the ambient air temperature is below the LTL and the hot water supply would initially be called for, a minimal amount of cold water may first be supplied. This minimum amount of cold water may be supplied based on the time of supply.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance comprising a treating chamber for receiving laundry to be treated according to an automatic cycle of operation, hot and cold water supplies, and a supply conduit fluidly coupling the hot and cold water supplies to the treating chamber through a chemistry dispenser, the method comprising:

alternating supplying of water from the hot and cold water supplies through the chemistry dispenser of the supply conduit to the treating chamber to form a mixture of hot and cold water in the treating chamber, the mixture having a predetermined set temperature;

sensing a temperature of the supply conduit upstream of the chemistry dispenser during the alternating supplying;

switching from the cold water supply to the hot water supply when the sensed temperature satisfies a low temperature limit (LTL);

switching from the hot water supply to the cold water supply when the sensed temperature satisfies a high temperature limit (HTL);

sensing an ambient air temperature; and increasing the LTL and the HTL from respective pre-defined values when the sensed ambient air temperature exceeds a temperature threshold.

2. The method of claim 1 wherein the alternating supplying of water is terminated when a volume of the mixture satisfies a predetermined volume threshold.

3. The method of claim 2 wherein satisfying the predetermined volume threshold comprises the volume falling within a predetermined volume range.

4. The method of claim 1 wherein the LTL and HTL predefined values are set based on the predetermined set temperature.

5. The method of claim 4 wherein the predetermined set temperature is set based on the cycle of operation.

6. The method of claim 5 wherein the predetermined set temperature is set as an option to the cycle of operation.

7. The method of claim 1 wherein the LTL and HTL are not adjusted for cold water cycles of operation.

8. The method of claim 1 wherein the LTL and HTL are not adjusted for hot water cycles of operation.

9. The method of claim 1 wherein the alternating supplying of water comprises supplying water from at least one of the hot or cold water supplies.

10. The method of claim 1 wherein the alternating supplying of water comprises supplying water from the hot and cold water supplies to an open top of a rotatable drum defining the treating chamber.

11. The method of claim 10 wherein the rotatable drum is rotatable about a substantially vertical axis of rotation.

12. The method of claim 11 wherein the rotatable drum is rotated about the vertical axis of rotation during the alternating supplying of water.

13. The method of claim 1 wherein the LTL and HTL are increased so a mixture ratio of hot to cold water is approximately the same when the appliance is operating in an environment at the sensed ambient temperature as when the appliance is operating in an environment at the temperature threshold.

14. The method of claim 1 wherein the LTL and HTL predetermined values are determined empirically using laboratory measurement.

* * * * *